US007742010B2

(12) United States Patent
Grossman et al.

(10) Patent No.: US 7,742,010 B2
(45) Date of Patent: Jun. 22, 2010

(54) ANTENNA ARRANGEMENT

(75) Inventors: Ovadia Grossman, Tel Aviv (IL); Moshe Ben-Ayun, Shoham (IL); Mark Rozental, Gedera (IL)

(73) Assignee: Motorola, Inc., Schaumburg, IL (US)

( * ) Notice: Subject to any disclaimer, the term of this patent is extended or adjusted under 35 U.S.C. 154(b) by 592 days.

(21) Appl. No.: 11/695,846

(22) Filed: Apr. 3, 2007

(65) Prior Publication Data

US 2007/0241972 A1 Oct. 18, 2007

(30) Foreign Application Priority Data

Apr. 13, 2006 (GB) ..... 0607481.9

(51) Int. Cl.
*H01Q 1/36* (2006.01)

(52) U.S. Cl. ..... 343/895; 343/853; 343/702

(58) Field of Classification Search ..... 343/895, 343/850, 853, 893, 702
See application file for complete search history.

(56) References Cited

U.S. PATENT DOCUMENTS

| | | | | |
|---|---|---|---|---|
| 2,910,695 | A | 10/1959 | Troost | |
| 3,550,145 | A | 12/1970 | Chen | |
| 3,594,798 | A | 7/1971 | Leydorf | |
| 4,302,760 | A | 11/1981 | Laufer | |
| 4,441,108 | A | 4/1984 | Ten Pas | |
| 5,490,284 | A | 2/1996 | Itoh | |
| 5,940,040 | A * | 8/1999 | Koyanagi et al. | 343/702 |
| 6,417,807 | B1 | 7/2002 | Hsu | |
| 6,828,938 | B2 | 12/2004 | Tran | |
| 6,870,509 | B2 * | 3/2005 | Ooe et al. | 343/711 |
| 6,888,505 | B2 | 5/2005 | Tran | |
| 6,903,704 | B2 | 6/2005 | Forster | |
| 6,954,180 | B1 * | 10/2005 | Braun et al. | 343/702 |
| 2005/0219128 | A1 | 10/2005 | Tan et al. | |
| 2005/0275598 | A1 | 12/2005 | Ohara | |
| 2007/0139282 | A1 * | 6/2007 | Haruyama | 343/702 |

FOREIGN PATENT DOCUMENTS

| | | | |
|---|---|---|---|
| EP | 0940924 | A2 | 8/1999 |
| EP | 1120917 | B1 | 12/2000 |
| EP | 1643591 | A1 | 5/2006 |
| JP | 2004274445 | A1 | 9/2004 |

(Continued)

OTHER PUBLICATIONS

Supplementary European Search Report Dated Jun. 9, 2009.

(Continued)

*Primary Examiner*—Douglas W Owens
*Assistant Examiner*—Dieu Hien T Duong
(74) *Attorney, Agent, or Firm*—Randi L. Karpinia; Anthony P. Curtis

(57) ABSTRACT

An antenna arrangement (1000) for use in an RF communication terminal including a plurality of resonators (1003, 1005, 1007, 1009) formed from a plurality of conducting wires (1002, 1004, 1008, 1010, 1012) the resonators being operable to provide radio frequency resonances in at least two different operational frequency bands (VHF, UHF, 700/800 MHz, GPS ranges) the wires being mutually adjacent and at least three of the wires having different lengths, and a plurality of radio frequency feed channels (113, 115, 117, 119) each being operably connected to an associated one of the resonators to deliver an RF signal between that resonator and an associated radio.

26 Claims, 5 Drawing Sheets

FOREIGN PATENT DOCUMENTS

| | | | |
|---|---|---|---|
| WO | WO2004042866 | A1 | 5/2004 |
| WO | WO2005088847 | A1 | 9/2005 |
| WO | WO9749141 | A1 | 3/2008 |

OTHER PUBLICATIONS

European Search Report Dated Jun. 17, 2009.
EPC Search Report Dated Mar. 1, 2010.
Hideaki, et al. "Antenna Device and Radio Equipment", Patent Abstracts of Japan, Publication No. 2004-274445; Sep. 30, 2004, 1 Page.
C.M. Desantis, "Low Profile Antenna Performance Study Part 11:Broadband Antenna Techniques Survey" Oct. 1977; Ecom, US Army Electronics Command Fort Monmouth, NJ, 43 Pages.
GBRI Search Report Dated Jul. 3, 2006.
PCT Search Report Dated Jul. 28, 2008.
J. Reynante "An Easy Dual-Band VHF/UHFAnetenna" Sep. 1994, 2 Pages.
Rashed, et al. "A New Class of Resonant Antennas" IEEE Transactions on Anetnnas and Propagation, vol. 39, No. 9, Sep. 1991, pp. 1428-1430.
Sneider, et al. "The Wideband Dipole-A Different Approach", Ham Radio, Oct. 1987, pp. 81-82.
Harold A. Wheeler, "The Wide-Band Matching Area for a Small Antenna", IEEE Transactions on Antennas and Progagation, vol Ap-31, No. 2, Mar. 1983, pp. 364-367.
P. Haapala, et al. "Dual Frequency Helical Antennas for Handsets", Vehicular Technology Conference, 1996, IEEE 46th vol. 1, Apr. 28-May 1, 1996; pp. 336-338.
Taiwan Search Report Dated Feb. 8, 2010.
Sunan Liu, et al., "A Frequency-Selectable Patch Antenna of Circular Polarization with Integrated MEMS Switches," IEEE/ACES International Conference on Wireless Communication and Applied Computational Electromagnetics, 2005, Honolulu, Hawaii, USA, Apr. 3-7, 2005, pp. 195-198.

* cited by examiner

ANTENNA ARRANGEMENT

FIELD OF THE INVENTION

The present invention relates to an antenna arrangement and an RF communication terminal incorporating the arrangement.

BACKGROUND OF THE INVENTION

User terminals for use in mobile communications, e.g. portable radios or telephones or radios carried in vehicles, conventionally support operation in a single RF (radio frequency) band, i.e. the operational band of the system. Such terminals employ an antenna to transform RF signals in an operational frequency band between a bound (conductor guided) form and a radiated form for over-the-air transmission. The antenna comprises a resonator designed to provide electrical resonance in the operational frequency band. Typically, a conventional resonator has a monopole or quarter wavelength linear conductor form.

Different mobile communication systems typically operate in different RF bands. Often the RF bands are in significantly different parts of the frequency spectrum. Some advanced terminals are being designed to provide operation in different systems and/or frequency bands and to provide continuous mobile connectivity whilst switching from one system/frequency band to another. Thus, antenna arrangements are required for use in such terminals which can operate in different frequency bands in one or more communication systems. Such arrangements are required to have a shape and size which is suitably compact and lightweight for user satisfaction.

Antenna arrangements employing resonators of conventional form have been found to be unsuitable for use in supporting communications in multiple systems/frequency bands owing to lack of satisfactory bandwidth. Resonators of unconventional form are known which provide multiple resonances but such resonators do not show sufficient bandwidth and operational efficiency when operated in widely different frequency bands. Furthermore, such resonators generally have a shape and size which does not easily fit into the terminal in a sufficiently compact manner.

SUMMARY OF THE INVENTION

According to the present invention in a first aspect there is provided an antenna arrangement as defined in claim 1 of the accompanying claims.

According to the present invention in a second aspect there is provided a terminal for a method of operation in a terminal for radio frequency communications.

Further features of the invention are as defined in the accompanying dependent claims and are disclosed in the embodiments of the invention to be described.

Embodiments of the present invention will now be described by way of example with reference to the accompanying drawings, in which:

DESCRIPTION OF EMBODIMENTS OF THE INVENTION

In embodiments of the invention to be described, an antenna arrangement for use in an RF communication terminal includes a plurality of resonators formed from a plurality of conducting wires, the resonators being operable to provide radio frequency resonances in at least two different operational frequency bands, the wires being mutually adjacent and at least three of the wires having different lengths, and a plurality of radio frequency feed channels each being operably connected to an associated one of the resonators to deliver an RF signal between that resonator and an associated radio.

Figure 1:
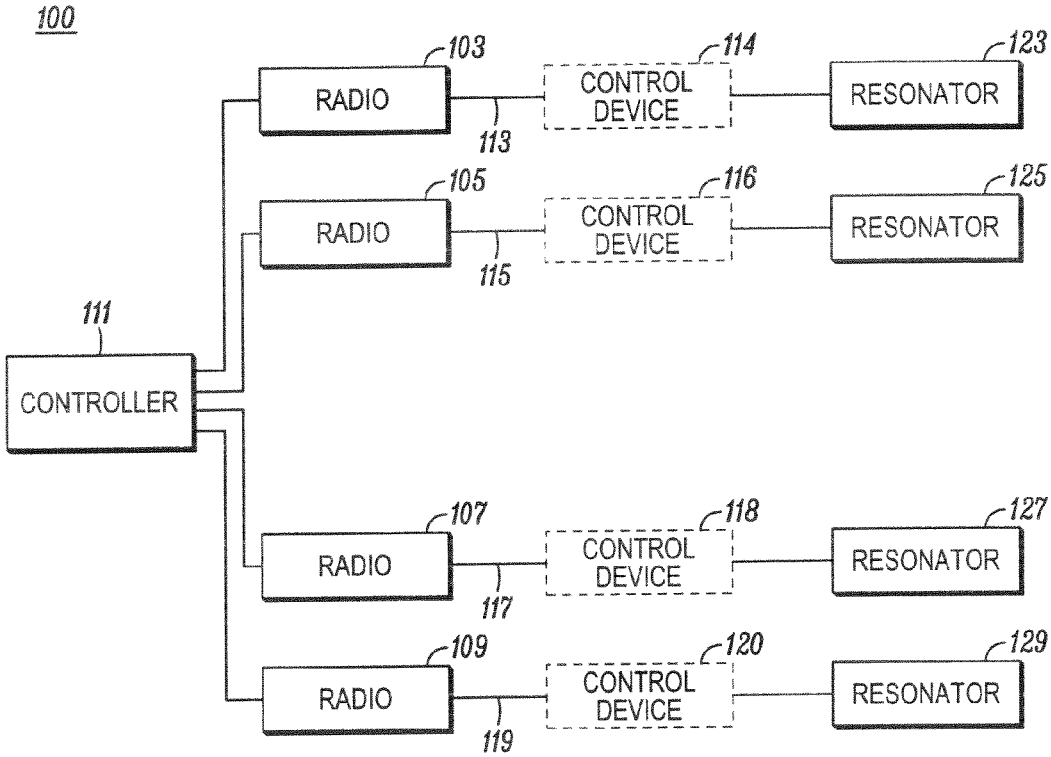
FIG. 1 is a block schematic circuit diagram of an illustrative wireless communication terminal embodying the invention.

FIG. 1 is a block schematic diagram illustrating in basic form an illustrative terminal 100 embodying the invention. The terminal 100 is for use in RF (radio frequency) communication. The terminal 100 may be a mobile station or a fixed terminal. The terminal 100 includes a radio (radio transceiver) 103, a radio 105, a radio 107 and a radio 109. The radios 103 to 109 operate in different frequency bands such as bands which include the ranges specified in Table 1 later. It will be appreciated that the four radios illustrated in FIG. 1 are for exemplary purposes, and that any plurality of radios is within the scope of the present invention.

A controller 111 controls selection of the radios 103 to 109 that are to be operational. Thus, the controller 111 may select any one or more of the radios 103 to 109 to be operational at any one time. Furthermore, the controller 111 selects whether each of the radios 103 to 109 is in a transmit mode, a receive mode or optionally a standby mode.

The radio 103 is operably connected via an RF feed channel 113 optionally including a control device 114 (whose operation is described later) to an associated resonator (antenna) 123. The radio 103, the channel 113 and the resonator 123 provide operation in a first frequency band B1. Similarly, the radio 105 is operably connected via an RF feed channel 115 optionally including a control device 116 (whose operation is described later) to an associated resonator 125. The radio 105, the channel 115 and the resonator 125 provide operation in a second frequency band B2. Similarly, the radio 107 is operably connected via an RF feed channel 117 optionally including a control device 118 (whose operation is described later) to an associated resonator 127. The radio 107, the channel 117 and the resonator 127 provide operation in a third frequency band B3. Similarly, the radio 109 is operably connected via an RF feed channel 119 optionally including a control device 120 (whose operation is described later) to an associated resonator 129. The radio 109, the channel 119 and the resonator 129 provide operation in a fourth frequency band B4. Thus, each of the resonators 123 to 129 is designed to resonate in one of the operational frequency bands B1 to B4. The resonators 123 to 129 are formed from wires and have physical properties which differ to give resonance in these required frequency bands. Examples of suitable forms of the resonators 123 to 129 and of antenna arrangements including the resonators 123 to 129 are described later.

Each of the resonators 123 to 129 when connected to an associated one of the radios 103 to 109 which is in a transmit mode converts a bound RF signal produced by the associated one of the radios 103 to 109 and delivered by an associated one of the feed channels 113 to 119 to a radiated RF form for over-the-air transmission to another terminal (not shown). Each of the resonators 123 to 129 when connected to an associated one of the radios 103 to 109 which is in a receive mode converts a received RF signal in radiated form to bound RF form for delivery via an associated one of the feed channels 113 to 119 to its associated one of the radios 103 to 109 for down-conversion and demodulation by the associated radio.

Examples of typical commercially significant frequency ranges which may be included in the operational frequency bands B1 to B4 are given in Table 1 as follows:

TABLE 1

| Radio | Resonator | Frequency band name | Frequency range name | Frequency range (MegaHertz) |
|---|---|---|---|---|
| 103 | 123 | B1 | VHF (very high frequency) | 136 to 174 |
| 105 | 125 | B2 | UHF (ultra high frequency) | 380 to 527 |
| 107 | 127 | B3 | 700/800 MHZ | 746 to 870 |
| 109 | 129 | B4 | GPS | 1572 to 1576 |

Where the radio 109 and the resonator 129 operate in the GPS frequency range, the radio 109 may operate in a receive mode only, to receive GPS (Global Positioning System) signals.

In alternative terminals embodying the invention, it may be necessary to employ only two or three of the radios 103 to 109 and their associated feed channels and resonators to provide operation in all of the frequency ranges specified in Table 1. Illustrative embodiments of the invention described later to provide operation in the ranges specified employ variously four, three and two radios.

As noted earlier, each of the feed channels 113 to 119 in the terminal 100 of FIG. 1 may include an associated control device 114 to 118. Each of the control devices 114 to 118 when present is a passive device which acts as a band pass filter in the prescribed operational frequency band B1 to B4 of the feed channel 113 to 119 in which its is included. Each of the control devices 114 to 118 also provides a selected impedance at frequencies which are out of the prescribed operational frequency band B1 to B4 of the feed channel 113 to 119 in which the control device is included, i.e. each control device provides a selected impedance at 'out of band' frequencies.

The selected impedance applied by each of the control devices 114 to 120 for out of band frequencies may be an impedance which is one of two types. A first type of impedance which may be selected and applied is equivalent to an open circuit of the feed channel (in which the particular control device is included) as seen from the one of the resonators 123 to 129 associated with that feed channel. Alternatively, a second type of impedance which may be selected and applied may be an impedance equivalent to a short circuit to ground of the feed channel (in which the particular control device is included) as seen from the one of the resonators 123 to 129 associated with that feed channel.

RF systems, generally, are designed to have a target impedance, e.g. fifty (50) ohms, in their operating range. Thus all components used in such a system, including band pass filters, are designed to have the target impedance in their operating frequency band or range. However, in general, the characteristic impedance of a band pass filter is not constant with frequency. Often the impedance is not specified for out of band operation of a band pass filter. However, in the case of the terminal 100, the out of band impedance provided by each of the control devices 114 to 120 is selected to be an impedance of the first or second type referred to above.

Thus, for a given frequency which is within the operating band of one particular resonator of the resonators 123 to 129, but not of the other resonators, the control device which is associated with that one resonator provides a band pass filter to pass frequencies in the operating frequency band of that one particular resonator. At the same time, each of the control devices of the feed channels associated with the other resonators, which are out of band relative to the operational band of the one particular resonator, applies at the given frequency one of the selected impedances described above. The particular impedance selected, i.e. of the first or second type, depends on how the wires of the resonators are selected to interact for a given operational frequency band. Examples of the use of selected impedances of the first and second types are given later.

Whilst the one particular resonator is operational in its own frequency band, any one or more of the other resonators which has at that frequency band an impedance of the first or second type for out of band frequencies can also be operational at the same time in its own frequency band, so the control device associated with that other resonator provides a filter which passes frequencies in the operational band of that other resonator.

As illustrated later, where the selected impedance of a feed channel comprises a short circuit to ground when the associated resonator is not used as a main operational resonator, the short circuit to ground may be employed beneficially to enhance the bandwidth of another resonator which is operational.

Figure 2:
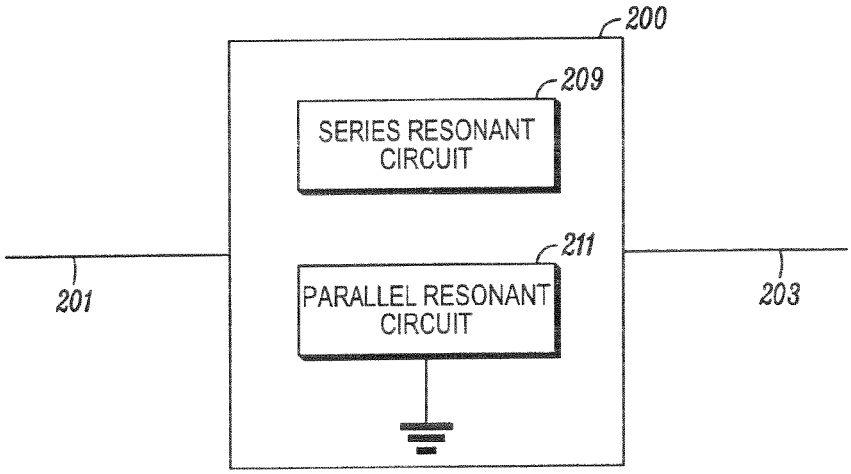
FIG. 2 is a block schematic diagram showing more detail of a control device included in the terminal of FIG. 1.

An illustrative schematic generic form 200 of control device for use as each of the control devices 114 to 120 is shown in FIG. 2. The form 200 of the control device is connected to a channel 201 and a channel 203. In the transmit mode of the terminal 100, the channel 201 acts as an input channel and delivers an RF signal from an associated one of the radios 103 to 109 to the channel 203 which acts as an output channel. The channel 203 delivers the RF signal to an associated one of the resonators 123 to 129. Similarly, in the receive mode of the terminal 100, the channel 203 acts as an input channel and delivers an RF signal from an associated one of the resonators 123 to 129 to the channel 201 which acts as an output channel. The channel 201 delivers the RF signal to an associated one of the radios 103 to 109. The channel 201 and the channel 203 together are included in one of the feed channels 113 to 119 of the terminal 100 shown in FIG. 1. The form 200 of the control device includes a combination of a series resonant circuit 209 and a parallel resonant circuit 211 connected to ground. Properties of the series resonant circuit 209 and the parallel resonant circuit 211 and their mutual interaction are selected in each case in a known manner to provide a pass band for the operational frequency band associated with the feed channel in which the control device is located and at frequencies above and below the pass band of one of the first and second impedance types described above, the selected impedance depending on the particular associated resonator. Examples of selected impedances to obtain operation in the frequency ranges listed in Table 1 earlier are described later.

Each of the control devices 114 to 120 may additionally include a tuning circuit (not shown) which may be employed in a known way to tune the (resonance of the) resonator 123 to 129 connected to the control device.

Although each of the control devices 114 to 120 have been described as passive devices they could be active devices programmed to give the required operation described above. In this case, the control devices could be combined as a single control device programmed to give the required operation described above.

The resonators 123 to 129 (or at least two of them) of the terminal 100, are formed from a plurality of adjacent conducting wires in which at least three of the wires have different sizes. Examples of antenna arrangements embodying the invention including multiple resonators formed from multiple wires having different sizes will be described later. Examples of individual resonators formed from conducting wires which may be used in such arrangements will first be described as follows.

Figure 3:
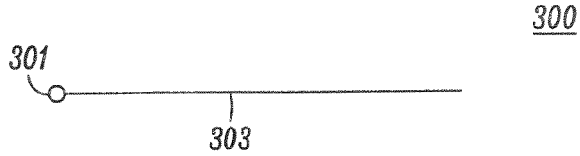
FIG. 3 is a side view of a wire resonator for use in embodiments of the invention.

A first form (example) 300 of resonator suitable for use in embodiments of the invention is shown in FIG. 3. This is a simple monopole resonator comprising a single straight wire 303 extending from an RF feed point 301 (an inner end of the wire 303) which is connected to an associated feed channel, e.g. one of the feed channels 113 to 119 of FIG. 1. The resonator form 300 may suitably have an effective electrical length which is equal to, or approximately equal to, a quarter wavelength, i.e. $\lambda/4$, where $\lambda$ is the wavelength of operation, i.e. the wavelength of radiation at the centre of the operational frequency band of the associated radio, i.e. one of the radios 103 to 109 in FIG. 1.

Figure 4:
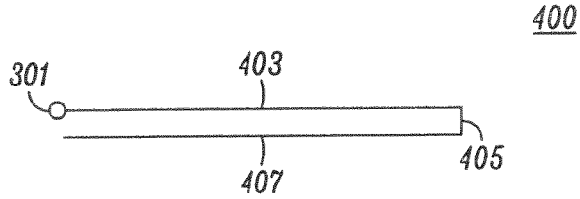
FIG. 4 is a side view of an alternative wire resonator for use in embodiments of the invention.

In FIG. 4, an alternative form (example) 400 of resonator for use in embodiments of the invention is shown. In the form 400, an RF feed point to the resonator is again indicated by reference numeral 301. The resonator form 400 includes a first straight wire portion 403 extending from the feed point 301 to a fold 405 and a second straight wire portion 407 extending from the fold 405 back toward the feed point 301. The second straight wire portion 407 has a free end (its inner end) adjacent to the feed point 301. The overall effective electrical length of the form 300 including the straight portions 403, 407 and the fold 405 may be, or may approximate to, a quarter wavelength ($\lambda/4$) or a half wavelength ($\lambda/2$) at the wavelength ($\lambda$) of operation.

Figure 5:
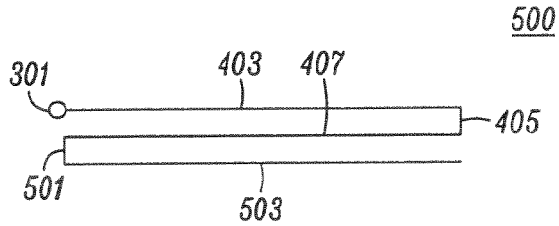
FIG. 5 is a side view of an alternative wire resonator for use in embodiments of the invention.

In FIG. 5, a further alternative form (example) 500 of resonator which may be used in embodiments of the invention is shown. Parts which are the same as parts shown in FIG. 4 have the same reference numerals. In the form 500, the end of the straight wire portion 407 at its end adjacent to the feed point 301 has a further fold 501. A further straight wire portion 503 extends from the fold 401 back toward the fold 405 but has a free end (outer end) adjacent to the fold 405. The overall effective electrical length of the resonator form 500 including the straight wire portions 403, 407 and 503 and the folds 405 and 501 may be or may approximate to a quarter wavelength ($\lambda/4$) or alternatively a half wavelength ($\lambda/2$) at the wavelength of operation.

Figure 6:
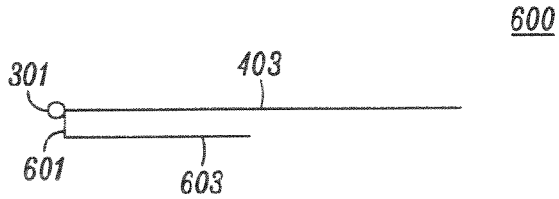
FIG. 6 is a side view of an alternative resonator for use in embodiments of the invention.

In FIG. 6, a further alternative form (example) 600 of resonator which may be used in embodiments of the invention is shown. Parts which are the same as parts shown in FIG. 5 have the same reference numerals. In the form 600, the straight wire portion 403 has a free end distant from the feed point 301. The form 600 has a fold 601 adjacent to the feed point 301 and further straight wire portion 603 extending from the fold 601 toward the free end of the portion 403. The further straight wire portion 603 is shorter than the straight wire portion 403. The portion 403 and the portion 603 may have effective electrical lengths equal to, or which approximate to, a quarter wavelength or a half wavelength at the wavelength of operation.

Figure 7:
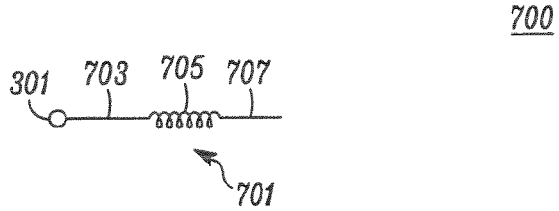
FIG. 7 is a partly diagrammatic side view of an alternative resonator for use in embodiments of the invention.

In FIG. 7, a further alternative form (example) 700 of resonator which may be used in embodiments of the invention is shown. In the form 700, the feed point 301 is again present. The form 700 includes a wire 701 extending from the feed point 301. The wire 701 includes a straight section 703 which leads to a helical coiled section 705 which in turn leads to a further straight section 707. The straight section 707 has a free end (outer end) distant from the feed point 301. The effective electrical length of the form 700 of resonator may be equal to, or may approximate to, a quarter wavelength or a half wavelength at the wavelength of operation. However, the physical length of the form 700 is arbitrary and is determined by the dimensions of coil.

Figure 8:
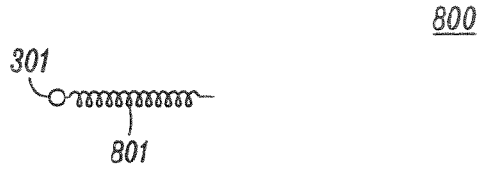
FIG. 8 is a partly diagrammatic side view of an alternative resonator for use in embodiments of the invention.

In FIG. 8, an alternative form (example) 800 of resonator which may be used in embodiments of the invention is shown. In the form 800, the feed point 301 is again present. The wire 701 of the form 700 is replaced in the form 800 by a helical coiled wire 801 which extends from the feed point 301 and has no straight section. The helical coiled wire 801 has a free end (outer end) distant from the feed point 301. The effective electrical length is again selected to be equal to, or to approximate to, a quarter wavelength or a half wavelength at the wavelength of operation.

Figure 9:
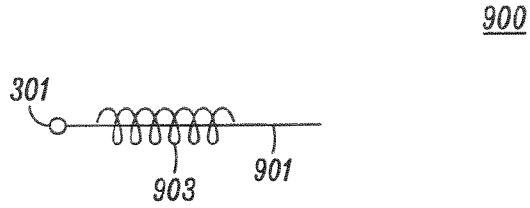
FIG. 9 is a partly diagrammatic side view of an alternative resonator for use in embodiments of the invention.

In FIG. 9, a further alternative form (example) 900 of resonator which may be used in embodiments of the invention is shown. In the form 900 the feed point 301 is again present. A straight wire portion 901 extends from the feed point 301. The straight wire portion 901 has a free end distant from the feed point 901. A helical coiled wire portion 903 coaxial with the straight wire portion 901 is formed around the straight wire portion 901. The helical coiled wire portion 903 may be galvanically unconnected to the straight wire portion 901, as shown in FIG. 9, or may alternatively be connected at one end to the straight wire portion 901. The effective electrical length is again selected to be equal to, or to approximate to, a quarter wavelength or a half wavelength.

Figure 10:
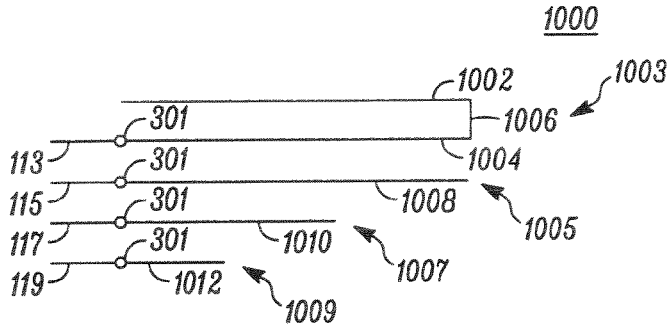
FIG. 10 is a side view of an illustrative antenna arrangement embodying the invention.

An antenna arrangement 1000 embodying the invention is shown in FIG. 10. The arrangement 1000 illustrates an arrangement of resonators produced from parallel conducting wires for use in the terminal 100 of FIG. 1. In the arrangement 1000, resonators 1003, 1005, 1007 and 1009 are provided to serve respectively as the resonators 123 to 129 indicated in FIG. 1. Thus, each of the resonators 1003, 1005, 1007 and 1009 is connected respectively to its associated one of the feed channels 113 to 119 which are also indicated in FIG. 10. In FIG. 10, each of the resonators 1003 to 1009 is shown as having a feed point 301 which indicates where each resonator is connected to its associated feed channel. Each of the feed points 301 shown in FIG. 10 is a separate feed point. The resonators 1003, 1005, 1007 and 1009 are formed from parallel conducting wires. The resonator 1001 has a folded wire form similar to the form 400 shown in FIG. 4, including straight wire portions 1002 and 1004 and a fold 1006. The resonators 1005, 1007 and 1009 are all similar to the monopole form 300 shown in FIG. 3 and include straight wires 1008, 1010 and 1012 respectively. The straight wire 1010 of the resonator 1007 has a length which is greater than that of the straight wire 1012 of the resonator 1009. The straight wire 1008 of the resonator 1005 has a length which is greater than that of the straight wire 1010 of the resonator 1007. The resonator 1003 has a length, including the individual lengths of both of the straight wire portions 1002 and 1004 and the fold 1006, which is greater than the length of the straight wire 1008 of the resonator 1005. A specific example, 'Example 1', of the antenna arrangement 1000 is described later.

Figure 11:
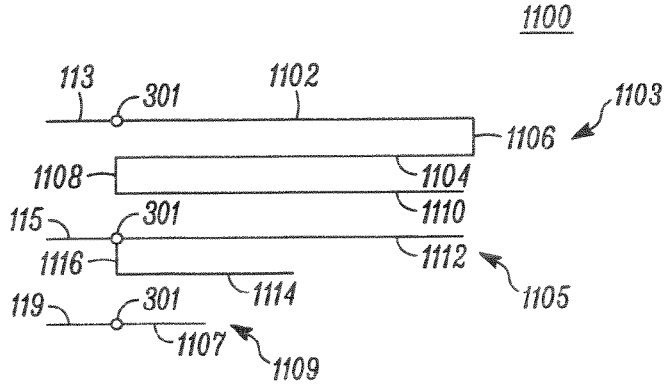
FIG. 11 is a side view of an alternative illustrative antenna arrangement embodying the invention.

An alternative antenna arrangement 1100 embodying the invention is shown in FIG. 11. The arrangement 1100 illustrates a further arrangement of resonators produced from parallel conducting wires. The arrangement 1100 is suitable for use in a terminal similar to the terminal 100 of FIG. 1 but in which only three of the radios of the terminal 100, namely the radios 103, 105 and 109, are employed. Thus, only the associated feed channels 113, 115 and 119 are employed and are indicated in FIG. 11. In the arrangement 1100, resonators 1103, 1105, and 1009 are provided to serve respectively as the resonators 123, 125 and 129 indicated in FIG. 1. Thus, the resonators 1103, 1105 and 1109 are connected respectively to the feed channels 113, 115 and 119.

In FIG. 11, each of the resonators 1103, 1105 and 1109 is shown as having a feed point 301 which indicates where the resonator is connected to its associated feed channel. Each of the feed points 301 shown in FIG. 11 is a separate feed point. The resonator 1103 has a form similar to the doubled folded form 500 shown in FIG. 5 including straight wire portions 1102 and 1104 connected by a fold 1106 and a further straight wire portion 1110 connected to the straight wire portion 1104 by a further fold 1108. The resonator 1105 has a form similar to the form 600 shown in FIG. 6 including a longer straight wire portion 1112, a shorter straight wire portion 1114 and a fold 1116 connecting the longer straight wire portion 1112 and the shorter straight wire portion 1114 near the feed point 301. Like the form 600, the resonator 1105 is a dual resonance resonator. The resonator 1109 has a single straight wire 1107 providing a form similar to the monopole resonator form 300 shown in FIG. 3.

The effective electrical length of the resonator 1105 is determined by the length of the longer straight wire portion 1112 which is greater than the length of the straight wire 1107 of the resonator 1109. The effective electrical length of the resonator 1103 is determined by the sum of the lengths of the straight wire portions 1102, 1104 and 1110 and the folds 1106 and 1108. That sum is greater than the length of the longer straight wire portion 1112 of the resonator 1103. A specific example, 'Example 2', of the antenna arrangement 1100 is described later.

Figure 12:
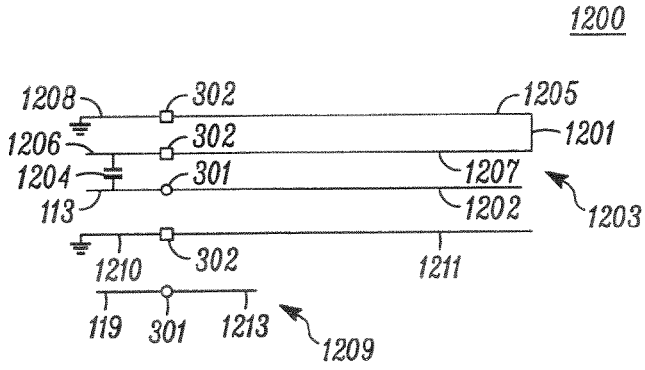
FIG. 12 is a partly diagrammatic side view of an alternative illustrative antenna arrangement embodying the invention.

An alternative antenna arrangement 1200 embodying the invention is shown in FIG. 12. The arrangement 1200 illustrates a further arrangement of resonators produced from parallel conducting wires. The arrangement 1200 is suitable for use in a terminal similar to the terminal 100 of FIG. 1 but in which only two of the radios of the terminal 100, namely the radios 103 and 109, are employed. Thus only the associated feed channels 113 and 119 are employed. In the arrangement 1200, resonators 1203 and 1209 are provided to serve respectively as the resonators 123 and 129 indicated in FIG. 1. Thus, the resonators 1203 and 1209 are connected respectively to the feed channels 113 and 119 which are indicated in FIG. 12.

In FIG. 12, each of the resonators 1203 and 1209 is shown as having a feed point 301 which indicates where the resonator is connected to its associated feed channel. Each of the feed points 301 shown in FIG. 12 is a separate feed point. Also, included in the arrangement 1200 are additional straight conducting wires 1205, 1207 and 1211 which are not connected directly to feed channels. Points 302 indicate inner ends of each of these additional wires.

The resonator 1203 includes a straight conducting wire 1202 which is connected to the feed channel 113 by the feed point 301 and is similar to the monopole form 300 of resonator shown in FIG. 3. The wire 1202 is capacitively coupled via the feed channel 113 by a capacitor 1204 to the straight wire 1207 via a connection 1206. The straight wire 1207 is connected in turn to the straight wire 1205 by a fold 1201. The wire 1205 is connected to ground by a connection 1208. The resonator 1209 has a straight wire 1213 providing a resonator of the simple monopole form 300 of FIG. 3. The straight wire 1213 is connected to the feed channel 119 via its feed point 301. The additional wire 1211 is located between the resonators 1203 and 1209. The additional wire 1211, that has a length about half the total length of the wires 1205 and 1207 of the resonator 1203, is connected to ground by a connection 1210. The purpose of the additional wire 1211 is to enhance the bandwidth of the resonator 1203 and to enable proper operation of the resonator 1209. A specific example, 'Example 3', of the antenna arrangement 1200 is described later.

The wires (excluding folds and connections) of the resonators in each of the arrangements 1000, 1100 and 1200 may extend parallel to a common axis. They may be mutually configured to be in a single plane in a comb like structure as illustrated in FIGS. 10 to 12. Alternatively, the wires forming the resonators may be mutually configured in a three dimensional arrangement, particularly one in which, in a cross-sectional plane perpendicular to a common axis of the resonators, the wires are at corners of a closed figure such as a square or a hexagon. Examples of such configurations are illustrated in FIGS. 13 and 14.

Figure 13:
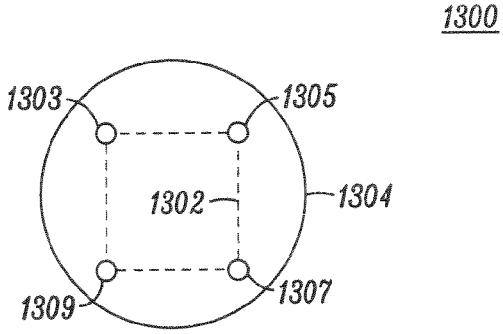
FIG. 13 is an end view of an antenna arrangement embodying the invention.

In FIG. 13, the wires forming the resonators, e.g. to provide the resonators 123 to 129 in the terminal 100, are in a configuration 1300. In the configuration 1300, the resonators all have the straight wire monopole form 300 with different lengths and extend perpendicular to the plane of FIG. 13 from a circular base 1304. The resonators are indicated in FIG. 13 as wire resonators 1303, 1305, 1307 and 1309 and are mutually configured in the plane of FIG. 13 to be at the corners of a square indicated by a dashed line 1303.

Figure 14:
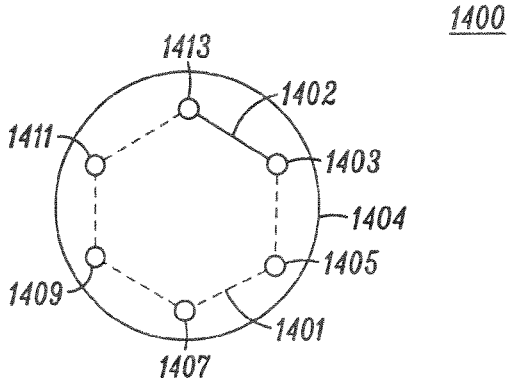
FIG. 14 is an end view of an alternative antenna arrangement embodying the invention.

In FIG. 14, the wires forming the resonators, e.g. resonators 123 to 129 in the terminal 100, are in a configuration 1400. The resonators are formed by straight wires 1403, 1405, 1407, 1409, 1411 and 1413 which extend perpendicular to the plane of FIG. 14 from a circular base 1404 similar to the base 1304 shown in FIG. 13. As seen in the plane of FIG. 14, the wires 1403, 1405, 1407, 1409, 1411 and 1413 are at respective corners (intersections between sides) of a regular hexagon indicated by a dashed line 1401. As an illustrative use of the straight wires 1403, 1405, 1407, 1409, 1411 and 1413, the three upper wires 1411, 1413 and 1403 shown in FIG. 14 may form a single resonator having the double folded form 500 shown in FIG. 5. The wires 1403 and 1413 of the arrangement 1400 are connected by a fold 1402, equivalent to the fold 501 in FIG. 5. The wires 1405, 1407 and 1409 at the three lower corners of the hexagon 1401 as shown in FIG. 10 are all straight wires of the monopole form 300 shown in FIG. 3. The wires 1405, 1407 and 1409 have different sizes.

The wires 1303 to 1309 forming resonators in the configuration 1300 may be considered to be in the form of a bundle extending respectively from the base 1304, and the wires 1403 to 1413 in the configuration 1400 may be considered to be in the form of a bundle extending from the base 1404. In each case, the wires and the resonators formed by them may be enclosed in an insulating casing (as illustrated later with reference to FIG. 15) attached to the base 1301 or 1401 to give mechanical and physical protection to the wires and the resonators formed by them. Beneficially, the shape and size of the casing together with the base 1301 or 1401 can be similar to that of a conventional single antenna in a mobile station.

The resonators employed in the embodiments of the invention described above may be formed from conducting wires which have a selected wire gauge (diameter) and a selected mutual separation between individual wires. In general, the gauge and the separation are selected according to the operational frequency bands of the radios 103 to 109 associated with the resonators which need to be covered in operation. For operation in the frequency ranges defined in Table 1 earlier, a suitable common gauge for the wires employed in all of the resonators, e.g. resonators 123 to 129, has been found to be in the range 0.5 mm (millimetres) to 1.5 mm, especially 0.8 mm to 1.2 mm, e.g. 1.0 mm. For operation in the frequency ranges defined in Table 1, a suitable minimum separation between the wires of the resonators, e.g. the resonators 123 to 129, has been found to be in the range 2d to 6d, especially 3d to 5d, e.g. 4d, where d is the gauge of the wire used to provide the resonators.

Figure 15:
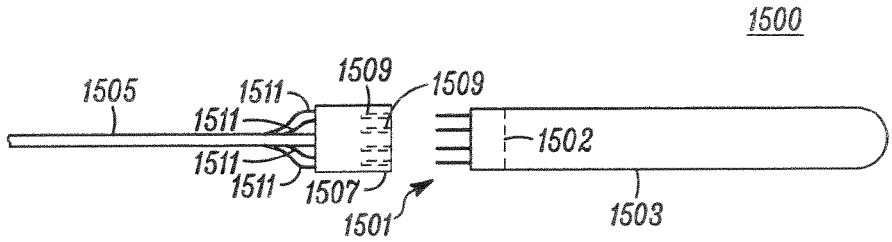
FIG. 15 is a partially exploded side view of an RF antenna arrangement embodying the invention, illustrating a form of construction of an antenna arrangement for use in the terminal of FIG. 1.

FIG. 15 is a partially exploded side view of an RF antenna arrangement 1500 embodying the invention. The arrangement 1500 illustrates a form of construction of the antenna arrangement in the terminal 100 of FIG. 1. The arrangement 1500 includes resonators formed from four single wires in the same manner as the wires 1303 to 1309 in the configuration 1300 of FIG. 13. The wires of the resonators are indicated in FIG. 15 collectively by reference numeral 1501. The wires 1501 are fitted in a circular base 1502, whose inner face is indicated in FIG. 15 by a dashed line. The base 1502 holds the wires 1501 in position. The wires 1501 are enclosed at their free ends, i.e. their ends which in operation are to be distant from the feed channels 113 to 119 shown in FIG. 1, in an insulating casing 1503 in which the circular base 1502 is also fitted.

The ends of the wires 1501 which in operation are to connect to the feed channels 113 to 119 (FIG. 1) are shown in FIG. 15 projecting outside the casing 1503 and the base 1502. The arrangement 1500 includes a circuit board 1505. A cylindrical connector 1507 having an insulating body is attached to the circuit board 1505 at one end of the circuit board 1505. The connector 1507 has internal sockets 1509 which are adapted to receive the wires 1501. The wires 1501 when fitted in the sockets of the connector 1507 are individually galvanically connected via internal conductors (not shown) in the connector 1507 to conducting leads 1511 which in turn are welded to the circuit board 1505. Two of the leads 1511 are welded to an upper surface of the circuit board 1505 and two of the leads 1511 are welded to a lower surface of the circuit board 1505 (although all of the leads could be alternatively be welded to a single surface of the circuit board 1505).

Figure 16:
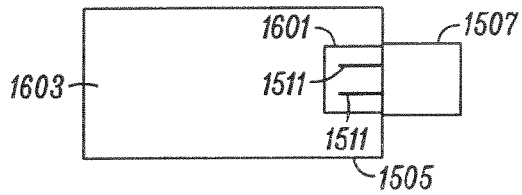
FIG. 16 is a plan view of a circuit board and a connector of the arrangement of FIG. 15.

FIG. 16 is a plan view of the circuit board 1505 and the connector 1507. An upper surface of the circuit board 1505 is shown together with the two of the conducting leads 1511 welded to that surface. The upper surface of the circuit board 1505 includes an insulating area 1601 in which the leads 1511 are welded and a larger area 1603 which is conducting, e.g. formed by a deposited and shaped layer of copper. The larger area 1603 forms a ground plane area at a potential of zero volts, needed to provide efficient operation of the resonators provided by the wires 1501.

The circuit board 1505 may carry all of the active operational components of the terminal 100 including radio circuits of the radios 103 to 109 shown in FIG. 1. The active operational components (not shown in FIGS. 15 and 16) may be on the lower surface of the circuit board 1505, i.e. the surface opposite to that shown in FIG. 16. Thus, the conducting leads 1511 may be connected to the feed channels 113 to 119 (FIG. 1), e.g. via lead through conductors (not shown) extending from the upper surface to the lower surface of the circuit board 1505.

It is to be noted that enclosure of the wires 1501 forming the resonators in the arrangement 1500 in the insulating casing 1503 attached to the base 1502 gives mechanical and physical protection to the wires and the resonators formed by them. Beneficially, the shape and size of the casing 1503 together with the base 1502 can be similar to that of a conventional single antenna in a mobile station. Thus, the antenna arrangement 1500 including the resonators formed by the bundle of wires 1501 can be compact and does not need to occupy a space greater than that of a single antenna operating at the in the lowest frequency range to be covered.

Figure 17:
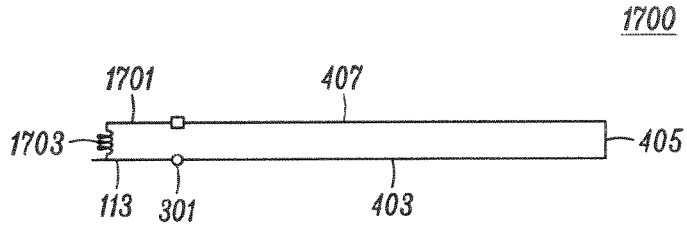
FIG. 17 is a partly diagrammatic side view of an alternative form of resonator for use in embodiments of the invention.

FIG. 17 shows an alternative form 1700 of resonator suitable for use in embodiments of the invention described above. The form 1700 is similar to the folded form 400 shown in FIG. 4 in which parts which are the same as those in FIG. 4 have the same reference numerals. Furthermore, the straight wire portion 403 is connected to the feed channel 113. In the form 1700, a connection 1701 galvanically connected to the straight wire portion 407 is inductively coupled to the feed channel 113 and thereby the wire portion 403 via an inductor 1703. The inductor 1703 provides an inductive coupling which enhances the frequency bandwidth of the form 1700 of resonator.

Figure 18:
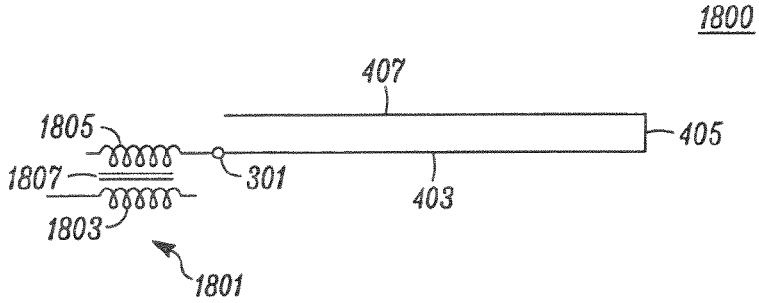
FIG. 18 is a partly diagrammatic side view of a resonator and its feed for use in embodiments of the invention.

FIG. 18 shows an alternative form 1800 of resonator suitable for use in embodiments of the invention described above. The form 1800 is similar to the folded form 400 shown in FIG. 4 in which parts which are the same as those in FIG. 4 have the same reference numerals. In the form 1800, a feed channel is connected to the straight wire portion 403 via the feed point 301. The feed channel comprises a transformer 1801 including a first coil 1803, a second coil 1805 and a magnetic core 1807 between the first coil 1803 and the second coil 1805. The transformer 1801 advantageously enhances the bandwidth of the resonator of form 1800, especially when the resonator of form 1800 is to be used in the VHF range defined in Table 1 earlier. In another resonator which is a medication of the form 1800, the transformer 1801 may be replaced by a transformer having an air gap between the coils 1803 and 1805 instead of the magnetic core 1807. Such a transformer is preferred at low frequencies, e.g. below 100 MHz (MegaHertz), or when it is desirable to minimise the size of the transformer 1801.

Terminals and antenna arrangements which are specific examples of embodiments of the invention described above will now be described.

Example 1

In this example of the terminal 100 shown in FIG. 1, the radios 103 to 109 of the terminal 100 operate in the ranges specified in Table 1. The resonators 123 to 129 are in an arrangement of the form 1000 shown in FIG. 10. The respective associated control devices 114 to 120 are employed in the feed channels 113 to 119. The control devices 114 to 120 give impedances as specified in Table 2 as follows. In Table 2, each of the fourth, fifth, sixth and seventh columns indicates an impedance state of each of the feed channels 113 to 119 in different ranges. 'ON' indicates that the radio associated with the feed channel listed is operational, i.e. in a transmit or receive mode; 'OPEN' indicates that the feed channel is out of band, and the associated control device 114 to 120 provides an impedance equivalent to an open circuit; and 'SHORT' indicates that the feed channel is out of band, and the associated control device 114 to 120 provides an impedance equivalent to a short circuit to ground.

TABLE 2

| RADIO | RESONATOR | Operational frequency range name | State of feed channel 113 | State of feed channel 115 | State of feed channel 117 | State of feed channel 119 |
|---|---|---|---|---|---|---|
| 103 | 123 | VHF | ON | OPEN | SHORT | SHORT |
| 105 | 125 | UHF | OPEN | ON | SHORT | SHORT |
| 107 | 127 | 700/800 MHz | SHORT | SHORT | ON | SHORT |
| 109 | 129 | GPS | OPEN | OPEN | OPEN | ON |

In this example, the impedance of the feed channels is selected in the following way to obtain the combinations listed in Table 2. Resonators which are not operational, i.e. not ON, are normally connected to a feed channel in which the control device 114 to 120 provides an impedance equivalent to an open circuit, i.e. the feed channel is in the OPEN state, unless the resonator has an electrical length which is less than that of an adjacent resonator which is operational, i.e. ON, in which case the feed channel of the resonator which is not operational is in the SHORT state.

When a resonator adjacent to another resonator in the ON state has a shorter electrical length and is in the OPEN state it has only a minor influence on the resonator in the ON state and has no detrimental effect on the operation of that resonator. However, when the same resonator in the OPEN state is adjacent to a longer resonator also in the OPEN state, it is unable to perform properly. By providing a short circuit connection to the longer resonator, the resonator in the ON state is not affected and performs adequately.

Furthermore, in this Example, the following conditions are provided for operation in the VHF range and in the UHF range. In these cases, the feed channel 117 connected to the radio 107 and the resonator 127 is in the SHORT state to beneficially enhance bandwidth in the VHF and UHF ranges. The resonator 127 is connected to ground permanently. This arrangement provides improved resonance frequency bandwidth for both of the UHF and 700/800 frequency ranges.

In Example 1, the geometrical antenna lengths specified in Table 3 as follows have been found to be suitable to give resonances in the frequency ranges specified:

TABLE 3

| Resonator | Frequency range name | Frequency range (MHz) | Wire length (height) (cm) |
|---|---|---|---|
| 123 | VHF | 136 to 174 | 16 (folded in the form 400) |
| 125 | UHF | 380 to 527 | 16 |
| 127 | 700/800 MHZ | 746 to 870 | 8 |
| 129 | GPS | 1572 to 1576 | 5 |

Using the configuration of Example 1, a resonance frequency bandwidth obtained for the VHF frequency range was about 38 MHz. In contrast, prior art antennas typically give a bandwidth of about 15 MHz for the same range. Using the configuration of Example 1, a resonance frequency bandwidth obtained for the UHF frequency range was about 147 MHz. In contrast, prior art antennas typically give a bandwidth of about 50 MHz for the same range. Using the configuration of Example 1, a resonance frequency bandwidth obtained for the 700/800 frequency range was about 124 MHz. In contrast, prior art antennas typically give a bandwidth of about 70 MHz for the same range.

Example 2

In this example, the radios 103, 105 and 109 of the terminal 100 are employed but the radio 107, the resonator 107 and the feed channel 117 are not employed. The frequency ranges specified in Table 1 are again covered in operation, but the radio 105, feed channel 115 and resonator 125 operate in a single wide band that covers both of the UHF and 700/800 MHz ranges. The resonators 123, 125 and 129 are in an arrangement of the form 1100 shown in FIG. 11.

The respective associated control devices 114, 116 and 120 of the feed channels 113, 115 and 119 (FIG. 1) may be operated to give impedances as specified in Table 3 as follows. In Table 4, each of the fourth, fifth and sixth columns indicates an impedance state of the feed channel 113, 115 and 119 associated with each radio 103, 105, 109 and each resonator 123, 125 and 129. 'ON' indicates that the associated radio listed is operational, i.e. in a transmit or receive mode; 'OPEN' indicates that the feed channel is out of band, and the control device provides an impedance equivalent to an open circuit; and 'SHORT' indicates that the feed channel is out of band, the control device provides an impedance equivalent to a short circuit to ground.

TABLE 4

| RADIO | RESONATOR | Frequency band name | State of feed channel 113 | State of feed channel 115 | State of feed channel 119 |
|---|---|---|---|---|---|
| 103 | 123 | VHF | ON | OPEN | SHORT |
| 105 | 125 | UHF/700/800 MHz | OPEN | ON | SHORT |
| 109 | 129 | GPS | OPEN | OPEN | ON |

Example 3

In this Example, only the radio 103, together with its associated feed channel 113 and its associated resonator 123, and the radio 109 together with its associated feed channel 119 and its associated resonator 129, are employed. The radios 105, 107, the feed channels 115 and 117 and the resonators 125 and 127 are not employed. The resonators 123 and 129 are in an arrangement of the form 1200 of FIG. 12. In this case, the radio 109 and the resonator 129 operate in the GPS frequency range. The other frequency ranges specified in Table 1 are also covered in operation, but the radio 103, the feed channel 113 and resonator 123 operate in a single wide band that covers all of the VHF, UHF and 700/800 MHz ranges.

The wire 1202 together with the wire 1211 of the form 1200 provides in this case resonances in the UHF and 700/800 ranges, and the wires 1202, 1207, 1201, and 1205 provide resonance in the VHF range. Beneficially, using the arrangement 1200 in this way reduces the number of active resonator/radio feed channel connections required.

Use of the form 1200 in the configuration of Example 3 has given the following resonances: an operational resonance frequency band of 136 MHz to 165 MHz for the VHF range; an operational resonance frequency band of 380 MHz to 550 MHz for the UHF range; and an operational resonance frequency band of 800 MHz to 870 MHz for the 700/800 range.

The antenna arrangements embodying the invention which have been described above beneficially can provide operation in any or all of the frequency ranges specified in Table 1 (as selected) whilst providing unusually wide band operation in the lower of those ranges, especially the specified VHF range. Such an antenna arrangement may be produced in a compact form which need not be substantially bulkier than a single antenna operating at the VHF range. Furthermore, the arrangement can simplify circuit constructions within a communication terminal in which the arrangement is used, since use of multiplexers to provide RF feeds between multiple radios and a single resonator can be avoided.

Although operation of antenna arrangements embodying the invention has been illustrated by reference to the frequency ranges specified in Table 1 earlier, operation is not limited to such ranges. For example, operation at 2.4 gigahertz (GHz) and/or 4.9 GHz can be provided for use in Bluetooth or WLAN (Wireless Local Area Network) communication systems by using one or more suitably sized resonators as will be apparent to those familiar with the art.

Although the present invention has been described in terms of the embodiments described above, especially with reference to the accompanying drawings, it is not intended to be limited to the specific form described in such embodiments. Rather, the scope of the present invention is limited only by the accompanying claims. In the claims, the terms 'comprising' or 'including' do not exclude the presence of other integers or steps. Furthermore, although individually listed, a plurality of means, elements or method steps may be implemented by, for example, a single unit or processor. Additionally, although individual features may be included in different claims, these may possibly be advantageously combined, and the inclusion in different claims does not imply that a combination of features is not feasible and/or advantageous. In addition, singular references do not exclude a plurality. Thus references to "a", "an", "first", "second" etc do not preclude a plurality.

The invention claimed is:

1. An antenna arrangement for use in a radio frequency (RF) communication terminal including:

a plurality of resonators formed from a plurality of conductive wires; and a plurality of radio frequency feed channels, each feed channel being operably connected to one of the resonators at a feed point of the resonator for delivering an RF signal between the resonator and an associated radio and providing an operational frequency band, wherein:

the number of the resonators is not less than the number of the feed channels, the resonators include mutually adjacent wires having different lengths extending from adjacent feed points, each of the feed channels includes a band pass filter operable to pass RF frequencies in the operational frequency band of the feed channel and an associated control device which controls an impedance of the feed channel at frequencies outside the operational frequency band, and coupling is provided between at least one resonator of the resonators whose feed channel is not the operational frequency band of at least one other resonator of the resonators with the at least one other resonator to enhance a resonance of the at least one other resonator.

2. An antenna arrangement according to claim 1 wherein the resonators include at least four wires having different lengths.

3. An antenna arrangement according to claim 1 wherein the wires are arranged in a comb like configuration or in a bundle.

4. An antenna arrangement according to claim 3 wherein the wires are mutually parallel.

5. An antenna arrangement according to claim 3 including an insulating casing enclosing the wires.

6. An antenna arrangement according to claim 3 including a connector adapted to receive an end of each of a plurality of the wires and to provide electrical connections from the received wires to conducting leads leading to the respective feed channels.

7. An antenna arrangement according to claim 3 wherein the wires are arranged in a bundle extending from a common base.

8. An antenna arrangement according to claim 1 wherein at least one of the wires comprises a monopole wire resonator.

9. An antenna arrangement according to claim 1 wherein at least two of the wires are electrically connected together by a galvanic, capacitive or inductive connection.

10. An antenna arrangement according to claim 9 wherein at least two of the wires have a galvanic connection at an end of the wires.

11. An antenna arrangement according to claim 1 wherein at least one of the wires comprises a folded wire resonator having at least two parallel straight portions.

12. An antenna arrangement according to claim 1 wherein at least one of the wires comprises a helical coil portion.

13. An antenna arrangement according to claim 1 including at least a first one of the wires operably connected to one of the feed channels and at least a second one of the wires which is longer than the first one of the wires and is connected to ground, the first and second wires together forming a half wavelength resonator.

14. An antenna arrangement according to claim 1 including an insulating substrate on which the feed channels are mounted.

15. An antenna arrangement according to claim 14 wherein the insulating substrate comprises an insulating circuit board which also has mounted thereon radio circuits operably connected to the feed channels.

16. An antenna arrangement according to claim 14 wherein the insulating substrate has formed thereon a layer of conducting material providing in operation a conducting ground plane.

17. An antenna arrangement according to claim 1 wherein each of the control devices is operable to provide at frequencies outside the operational frequency band of its feed channel an impedance selected from a first impedance type equivalent to an open circuit impedance and a second impedance type equivalent to a short circuit to ground.

18. An antenna arrangement according to claim 17 wherein a first one of the control devices provides for a first feed channel connected to a first resonator at frequencies outside the operational frequency band of the first feed channel an impedance of the second type when a second feed channel connected to a second resonator is in an operational frequency band and the first resonator has an electrical length which is greater than that of the second resonator.

19. An antenna arrangement according to claim 17 wherein a first one of the control devices provides for a first feed channel connected to a first resonator at frequencies outside the operational frequency band of the first feed channel an impedance of the first type when a second feed channel connected to a second resonator is in an operational frequency band and the first resonator has an electrical length less than that of the second resonator.

20. An antenna arrangement according to claim 17 wherein at least one of the resonators has an operational frequency band which in operation has a resonance enhanced by the presence of at least one wire which is not directly connected to the feed channel associated with the resonator.

21. An antenna arrangement according to claim 1 wherein a feed channel of at least one of the resonators includes a dual coil transformer.

22. An antenna arrangement according to claim 1 including four resonators having different electrical lengths, three of the resonators being monopole resonators and one of the resonators being a folded wire resonator.

23. An antenna arrangement according to claim 1 including three resonators having different electrical lengths including a first resonator which is a monopole resonator, a second resonator which is a folded wire resonator and a third resonator having two wires having different lengths and open outer ends and a connection between the wires at an inner end of the wires.

24. An antenna arrangement according to claim 1 including a first resonator which is a monopole resonator which is capacitively coupled to a folded wire having a connection to ground, a second resonator which is a monopole resonator and, between the first resonator and the second resonator, a wire connected to ground.

25. An antenna arrangement according to claim 1 wherein the resonators are operable to resonate in frequency bands which include frequencies in ranges selected from at least two of the following ranges: (i) 136 MegaHertz to 174 MegaHertz; (ii) 380 MegaHertz to 527 MegaHertz; (iii) 746 MegaHertz to 870 MegaHertz; and (iv) 1572 MegaHertz to 1576 MegaHertz.

26. An antenna arrangement according to claim 1 including a branched resonator connected to a single feed channel and having dual resonances.

* * * * *

UNITED STATES PATENT AND TRADEMARK OFFICE

CERTIFICATE OF CORRECTION

PATENT NO. : 7,742,010 B2
APPLICATION NO. : 11/695846
DATED : June 22, 2010
INVENTOR(S) : Grossman et al.

It is certified that error appears in the above-identified patent and that said Letters Patent is hereby corrected as shown below:

In Column 13, Line 64, in Claim 1, delete “wires;” and insert -- wires, --, therefor.

In Column 14, Line 8, in Claim 1, after “includes a” insert -- control device which acts as --.

In Column 14, Lines 10-11, in Claim 1, after “and” delete “an associated control device which”.

In Column 14, Line 12, in Claim 1, delete “band,” and insert -- band using an impedance selected from a set of discrete impedances, --, therefor.

In Column 14, Line 15, in Claim 1, after “not” insert -- in --.

In Column 14, Line 19, in Claim 2, delete “An” and insert -- The --, therefor.

In Column 14, Line 22, in Claim 3, delete “An” and insert -- The --, therefor.

In Column 14, Line 26, in Claim 4, delete “An” and insert -- The --, therefor.

In Column 14, Line 28, in Claim 5, delete “An” and insert -- The --, therefor.

In Column 14, Line 30, in Claim 6, delete “An” and insert -- The --, therefor.

In Column 14, Line 35, in Claim 7, delete “An” and insert -- The --, therefor.

In Column 14, Line 38, in Claim 8, delete “An” and insert -- The --, therefor.

In Column 14, Line 40, in Claim 9, delete “An” and insert -- The --, therefor.

In Column 14, Line 43, in Claim 10, delete “An” and insert -- The --, therefor.

Signed and Sealed this
Eighth Day of January, 2013

David J. Kappos

David J. Kappos
*Director of the United States Patent and Trademark Office*

In Column 14, Line 46, in Claim 11, delete “An” and insert -- The --, therefor.

In Column 14, Line 49, in Claim 12, delete “An” and insert -- The --, therefor.

In Column 14, Line 51, in Claim 13, delete “An” and insert -- The --, therefor.

In Column 14, Line 57, in Claim 14, delete “An” and insert -- The --, therefor.

In Column 14, Line 60, in Claim 15, delete “An” and insert -- The --, therefor.

In Column 14, Line 64, in Claim 16, delete “An” and insert -- The --, therefor.

In Column 15, Line 1, in Claim 17, delete “An” and insert -- The --, therefor.

In Column 15, Line 7, in Claim 18, delete “An” and insert -- The --, therefor.

In Column 15, Line 15, in Claim 19, delete “An” and insert -- The --, therefor.

In Column 15, Line 23, in Claim 20, delete “An” and insert -- The --, therefor.

In Column 15, Line 28, in Claim 21, delete “An” and insert -- The --, therefor.

In Column 16, Line 1, in Claim 22, delete “An” and insert -- The --, therefor.

In Column 16, Line 5, in Claim 23, delete “An” and insert -- The --, therefor.

In Column 16, Line 13, in Claim 24, delete “An” and insert -- The --, therefor.

In Column 16, Line 19, in Claim 25, delete “An” and insert -- The --, therefor.

In Column 16, Line 26, in Claim 26, delete “An” and insert -- The --, therefor.